US009802076B2

(12) United States Patent
Murray et al.

(10) Patent No.: US 9,802,076 B2
(45) Date of Patent: Oct. 31, 2017

(54) RECUMBENT EXERCISE MACHINES AND ASSOCIATED SYSTEMS AND METHODS

(71) Applicant: Dyaco International, Inc., Taipei (TW)

(72) Inventors: Brian Murray, Shalu (TW); Yuhsiang Chen, Tai-Ping (TW); Kuang-Shiung Kao, Longjing (TW)

(73) Assignee: DYACO INTERNATIONAL, INC., Taipei (TW)

( * ) Notice: Subject to any disclaimer, the term of this patent is extended or adjusted under 35 U.S.C. 154(b) by 805 days.

(21) Appl. No.: 14/086,880

(22) Filed: Nov. 21, 2013

(65) Prior Publication Data

US 2015/0141200 A1 May 21, 2015

(51) Int. Cl.
*A63B 22/04* (2006.01)
*A63B 22/00* (2006.01)
(Continued)

(52) U.S. Cl.
CPC ..... *A63B 22/04* (2013.01); *A63B 21/0023* (2013.01); *A63B 21/0058* (2013.01);
(Continued)

(58) Field of Classification Search
CPC ... A63B 5/11; A63B 24/0021; A63B 24/0084; A63B 24/0075; A63B 24/0059; A63B 71/0669; G01B 21/32; G04F 8/00
See application file for complete search history.

(56) References Cited

U.S. PATENT DOCUMENTS 5,356,356 A 10/1994 Hildebrandt et al.
5,836,855 A * 11/1998 Eschenbach ..... A63B 22/001 482/51
(Continued)

FOREIGN PATENT DOCUMENTS

TW 310604 7/1997
TW 451698 8/2001
(Continued)

OTHER PUBLICATIONS

Office Action Dated Jan. 13, 2016 in corresponding Taiwan Patent Application No. 103127875.
(Continued)

*Primary Examiner* — Sundhara Ganesan
(74) *Attorney, Agent, or Firm* — Finnegan, Henderson, Farabow, Garrett & Dunner, LLP

(57) ABSTRACT

The present disclosure is directed to recumbent exercise machines and associated systems and methods. In one embodiment, for example, a recumbent exercise apparatus can include a seat, two linear guide tracks forward of the seat, and two pedal assemblies movably coupled to corresponding linear guide tracks positioned forward of the seat. The pedal assemblies can be configured to move back and forth along the linear guide tracks. The recumbent exercise apparatus can further include linear actuators operably coupled to each of the linear guide tracks and configured to move the linear guide tracks up and down in a vertical direction. The pedal assemblies can be configured to move in elliptical patterns when the pedal assemblies move back and forth along the linear guide tracks and the linear actuators move the linear guide tracks up and down.

42 Claims, 9 Drawing Sheets

(51) Int. Cl.

| | |
|---|---|
| ***A63B 21/04*** | (2006.01) |
| ***A63B 21/00*** | (2006.01) |
| ***A63B 24/00*** | (2006.01) |
| ***A63B 21/002*** | (2006.01) |
| *A63B 22/20* | (2006.01) |
| *A63B 21/005* | (2006.01) |
| *A63B 22/06* | (2006.01) |

(52) U.S. Cl.

CPC ..... *A63B 21/0414* (2013.01); *A63B 21/154* (2013.01); *A63B 22/0046* (2013.01); *A63B 22/0056* (2013.01); *A63B 22/0087* (2013.01); *A63B 22/208* (2013.01); *A63B 24/0087* (2013.01); *A63B 21/005* (2013.01); *A63B 22/0012* (2013.01); *A63B 22/201* (2013.01); *A63B 2022/002* (2013.01); *A63B 2022/0038* (2013.01); *A63B 2022/0041* (2013.01); *A63B 2022/067* (2013.01); *A63B 2208/0233* (2013.01); *A63B 2208/0238* (2013.01); *A63B 2220/10* (2013.01); *A63B 2220/13* (2013.01); *A63B 2220/30* (2013.01); *A63B 2220/54* (2013.01); *A63B 2225/09* (2013.01)

(56) References Cited

U.S. PATENT DOCUMENTS

| | | | | |
|---|---|---|---|---|
| 6,171,217 | B1 * | 1/2001 | Cutler | A63B 22/0664 482/52 |
| 6,790,162 | B1 | 9/2004 | Ellis et al. | |
| 6,926,646 | B1 * | 8/2005 | Nguyen | A63B 22/001 428/70 |
| 7,691,034 | B2 * | 4/2010 | May | A63B 22/0012 482/52 |
| 8,062,191 | B2 | 11/2011 | Coates | |
| 2002/0072452 | A1 * | 6/2002 | Torkelson | A63B 23/03541 482/51 |
| 2008/0045385 | A1 * | 2/2008 | Eschenbach | A63B 22/001 482/52 |
| 2014/0080675 | A1 * | 3/2014 | Anderson | A63B 71/0622 482/52 |

FOREIGN PATENT DOCUMENTS

| | | | |
|---|---|---|---|
| TW | 571786 | | 1/2004 |
| TW | M284404 | | 1/2006 |
| TW | 201318669 | A | 5/2013 |
| WO | WO2010/139015 | A1 | 12/2010 |
| WO | WO2011/130561 | A2 | 10/2011 |

OTHER PUBLICATIONS

European Search Report dated Oct. 19, 2015 in related European Application No. 14184417.5.

* cited by examiner

RECUMBENT EXERCISE MACHINES AND ASSOCIATED SYSTEMS AND METHODS

TECHNICAL FIELD

The present disclosure relates generally to exercise apparatuses and, more particularly, to recumbent exercise machines and associated systems and methods.

BACKGROUND

Exercise machines include both resistance machines (e.g., weight machines, spring-loaded machines, etc.) and endless-path machines (e.g., exercise bikes, treadmills, elliptical trainers, etc.), and are typically used to enhance the strength and/or conditioning of the user. Various endless-path machines, such as exercise bikes, have recumbent or seated configurations that are intended to decrease the overall impact load on the body and/or to work different muscles than upright exercise machines. Recumbent exercise machines can also accommodate persons with limited mobility, decreased ranges of motion, and/or other health concerns, and may be used for rehabilitation and/or physical therapy in a clinical setting or at home. Recumbent bikes and stepper devices, for example, can provide a means for lower body exercise and/or physical therapy for users with injured legs or arms and/or cardiovascular concerns.

U.S. Pat. No. 5,356,356 to Hilderbrant et al., for example, is directed to a recumbent exercise device that includes a pair of pedals attached to a corresponding pair of leg levers and a pair of arm levers. The leg and arm levers are pivotally supported by a frame for movement about a transverse pivot axis, and are connected to each other for contralateral movement that simulates a walking motion. A magnetic resistance mechanism is coupled to the arm and leg levers to provide resistance about the pivot axis of the levers. U.S. Pat. No. 6,790,162 to Ellis et al. is directed to a recumbent stepper device similar to that of U.S. Pat. No. 5,356,356, except the arm and leg levers are not pivotally disposed on the same axis. This independent coupling increases the range of motion of the arm and leg levers. These recumbent stepper devices, however, provide only a single stepping motion without the ability to change the leg path, range of motion, and/or other parameters of the exercise device.

DETAILED DESCRIPTION

The present disclosure describes various embodiments of recumbent exercise machines and associated systems and methods. Recumbent exercise apparatuses or machines configured in accordance with several embodiments of the disclosure include pedals that move in an elliptical pattern. In certain embodiments, the recumbent exercise machines described herein can include software for selectively changing the elliptical pattern and/or stride length of the pedals to accommodate different ranges of motion. Certain details are set forth in the following description and in FIGS. 1A-4E to provide a thorough understanding of various embodiments of the disclosure. Other well-known structures and systems often associated with exercise machines, devices for monitoring exercise parameters, and related systems have not been shown or described in detail below to avoid unnecessarily obscuring the descriptions of the various embodiments of the disclosure. Additionally, a person of ordinary skill in the relevant art will understand that the disclosure may have additional embodiments that may be practiced without several of the details described below. In other instances, those of ordinary skill in the relevant art will appreciate that the methods and systems described can include additional details without departing from the spirit or scope of the disclosed embodiments.

Many of the details, dimensions, functions and other features shown and described in conjunction with the Figures are merely illustrative of particular embodiments of the disclosure. Accordingly, other embodiments can have other details, dimensions, functions and features without departing from the spirit or scope of the present disclosure. In addition, those of ordinary skill in the art will appreciate that further embodiments of the disclosure can be practiced without several of the details described below.

Figure 1A:
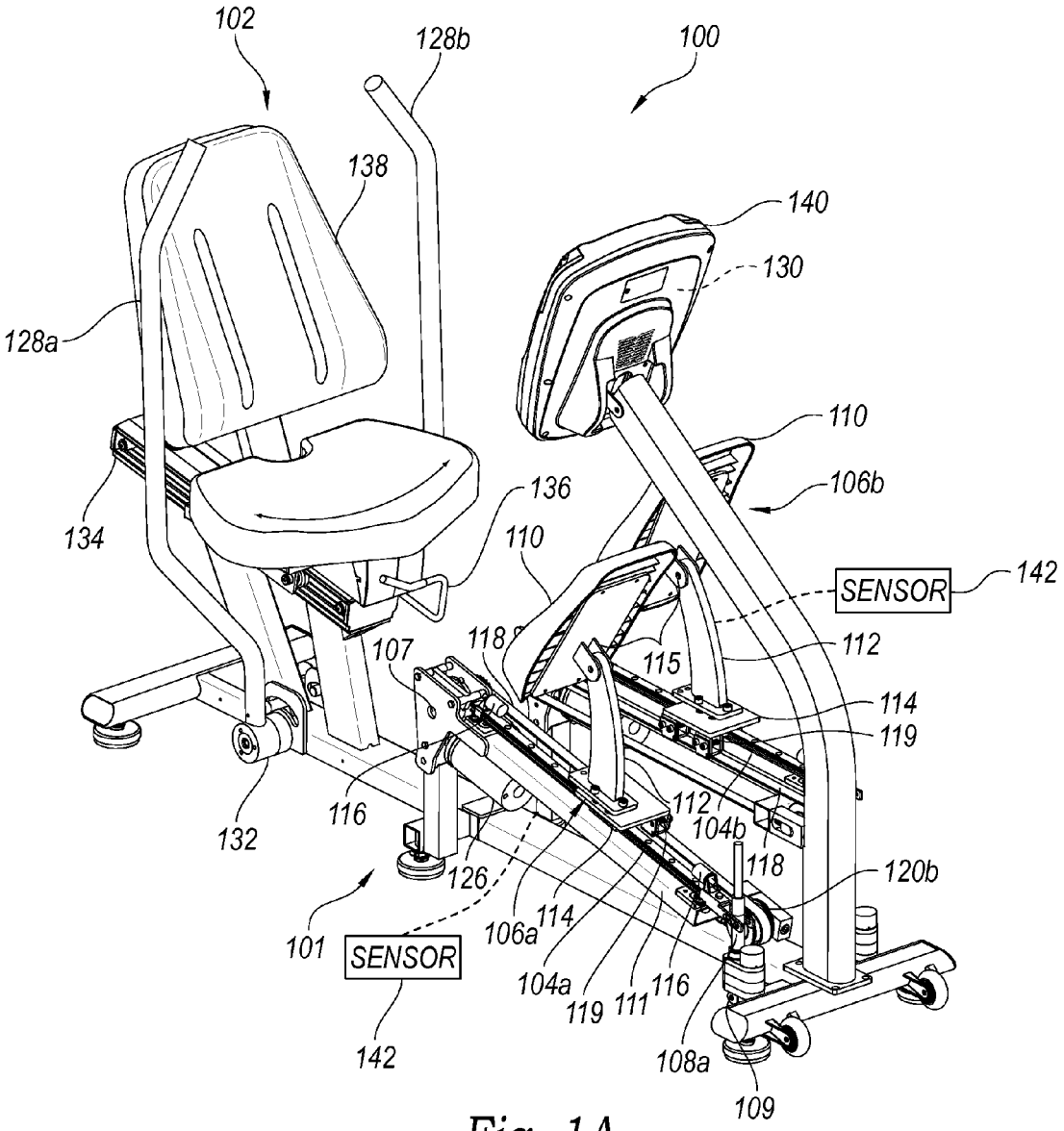
FIGS. 1A-1C are front isometric, back isometric, and side views, respectively, of a recumbent exercise device configured in accordance with an embodiment of the disclosure.
Figure 1B:
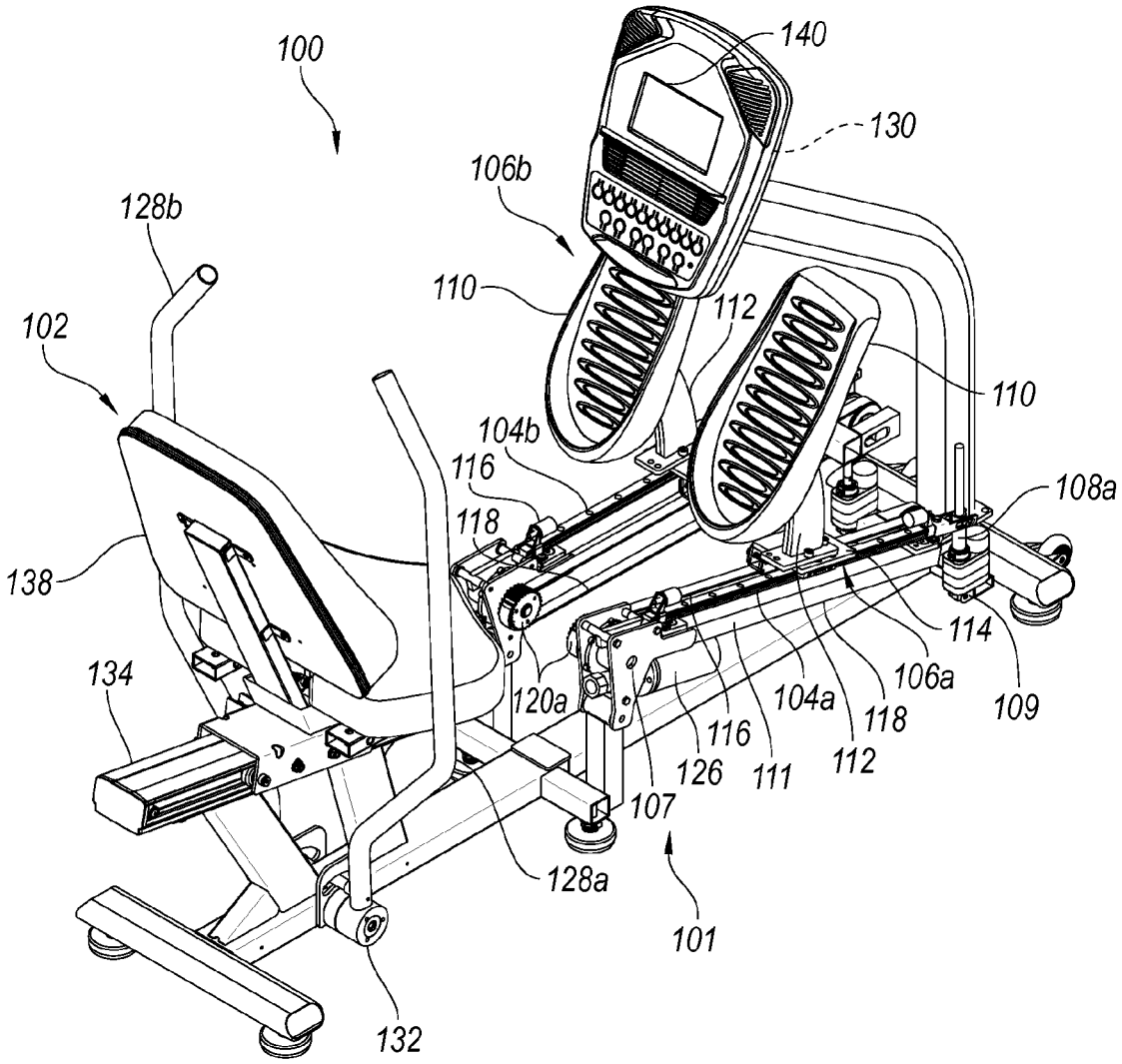
Figure 1C:
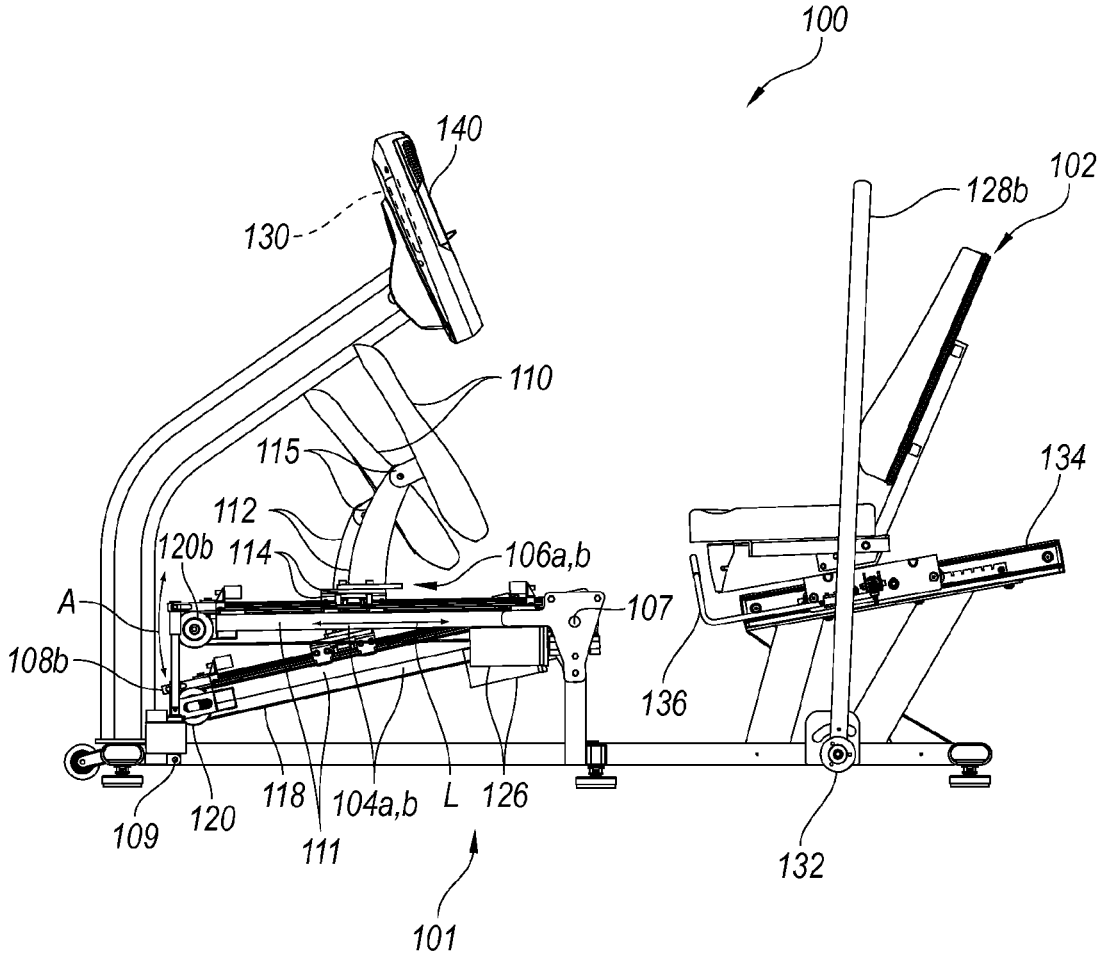

FIGS. 1A-1C are front isometric, back isometric, and side views, respectively, of a recumbent exercise machine or apparatus 100 ("exercise apparatus 100") configured in accordance with an embodiment of the disclosure. As shown in FIGS. 1A-1C, the exercise apparatus 100 can include a seat 102 adjustably mounted to a base structure 101. Two guide tracks (e.g., two linear guide tracks; identified individually as a first guide track 104*a* and a second guide track 104*b*, and referred to collectively as guide tracks 104) are also mounted to the base structure 101 forward of the seat 102. Two foot pedal assemblies (identified individually as a first pedal assembly 106*a* and a second pedal assembly 106*b*, and referred to collectively as pedal assemblies 106) are movably coupled to the first and second guide tracks 104*a* and 104*b*, respectively, and move (e.g., slide) back and forth along the lengths of the guide tracks 104 (e.g., as indicated by the arrow L in FIG. 1C).

The recumbent exercise apparatus 100 can further include two actuators (identified individually as a first actuator 108*a* and a second actuator 108*b*, and referred to collectively as actuators 108) operably coupled to the first and second guide tracks 104*a* and 104*b*, respectively. More specifically, in the embodiment illustrated in FIGS. 1A-1C, the actuators 108 are operably coupled to the end portions of the guide tracks 104 furthest from the seat 102, but in other embodiments, the actuators 108 can be operably coupled to the guide tracks 104 in positions closer to the seat 102 (e.g., at medial portions of the guide tracks 104, or at the end portions of the guide tracks 104 nearest to the seat 102). The actuators 108 create motion in a straight line (e.g., vertical motion), and can be, for example, linear actuators that include a traveling nut on a worm screw driven by a stepper motor and/or other suitable linear actuator configurations. In operation, the actuators 108 can be configured to alternatingly move the guide tracks 104 upwardly and downwardly about a pivot point in a vertical arc (e.g., as indicated by the arrow A in FIG. 1C). For example, as shown in FIG. 1A, the guide tracks 104 can rotate about pivot points 107 proximate to the seat 102 when the actuators 108 move in the vertical arc A, and the actuators 108 can rotate about pivot points 109 to accommodate the vertical movement of the linear guide paths 104. This vertical motion of the pedal assemblies 106, in combination with the horizontal motion of the pedal assemblies 106 along the guide tracks 104, moves the pedal assemblies 106 in substantially elliptical patterns or paths. Accordingly, the exercise apparatus 100 enables users to exercise their lower body with elliptical foot motion. As described in further detail below, in other embodiments, the exercise apparatus 100 can provide users with a linear-stepping motion and/or a rotary-type foot motion.

Each pedal assembly 106 can include a pedal 110 coupled (e.g., pivotally coupled) to a lever or arm member 112, which is in turn coupled to a pedal base or carriage 114 that slides horizontally back and forth along the corresponding guide track 104. One end portion of the arm member 112 can include a coupling mechanism 115 that pivotally attaches to the pedal 110 so that the angle of the pedal 110 can be adjusted. In certain embodiments, the coupling mechanism 115 can be an actuator or other mechanical means that can automatically vary the rotational position of the pedal 110 relative to the arm member 112 to accommodate various degrees of extension or flexion of the user's ankle joint as the pedal assembly 106 moves along the guide track 104. In other embodiments, the coupling mechanism 115 can fix the pedal 110 into a desired position relative to the arm member 112.

As shown in FIGS. 1A-1D, each guide track 104 can include a bar or rod, such as those used in computer numerical control ("CNC") machines, but in other embodiments the guide tracks 104 can have other configurations that allow the carriages 114 to move back and forth in a linear fashion. For example, each guide track 104 can include two tubes that are slideably coupled to the carriages 114. The guide tracks 104 can be slideably coupled to square or round support members 111 (e.g., bars or shafts) via mounting brackets at each end of the guide tracks 104, and the support members 111 can stabilize and/or otherwise support the guide tracks 104, the pedal assemblies 106, and/or additional components associated with the exercise apparatus 100 (e.g., drive units, timing belts, pulleys, motors, braking mechanisms, etc.). Each carriage 114 can be coupled to the corresponding guide track 104 with a linear-motion bearing that allows for one-dimensional motion along the guide track 104 to provide a linear-step motion. For example, the carriage 114 can include a mounting bracket that operably couples the carriage 114 to the corresponding guide track 104 via, e.g., a slide bearing. In other embodiments, the carriages 114 can be coupled to the guide tracks 104 using other suitable attachment means that allow for longitudinal movement along the guide tracks 104. Stoppers 116 can be positioned at or near each end of the guide track 104 to define the maximum distance the pedal assembly 106 can travel along the guide track 104 before returning in the opposite direction. As described in further detail below, in certain embodiments the pedal assemblies 106 can be communicatively coupled to a controller 130 (e.g., a computer) via a wireless or wired connection, and can be configured to limit or adjust the range of motion of the carriages 114 along the guide tracks 104. For example, the controller 130 can include software algorithms that limit the distance the carriages 114 move away from the seat 102 so that the user does not fully extend his or her legs when pedaling, and/or limit the carriages 114 from moving proximally toward the seat 102 to prevent the user from bending his or her knees to an unacceptable degree.

The controller 130 can include a processor that executes computer readable instructions stored on memory to implement various different functions of the exercise apparatus 100, such as controlling movement of the pedal assemblies 106, operation of the actuators 108, changing resistance applied to the pedal assemblies 106, and detecting various operational parameters (e.g., torque, position, etc.). The controller 130 can be operably coupled to the pedal assemblies 106, the actuators 108, drive units, motors, braking mechanisms, sensors, etc. As described in greater detail below, the controller 130 can also include a communications facility (e.g., a router, modem, etc.) for remotely exchanging information with various features of the exercise device and/or remote computing devices (e.g., mobile phones, computers, etc.) for performing the various functions performed by the exercise apparatus 100

Figure 1D:
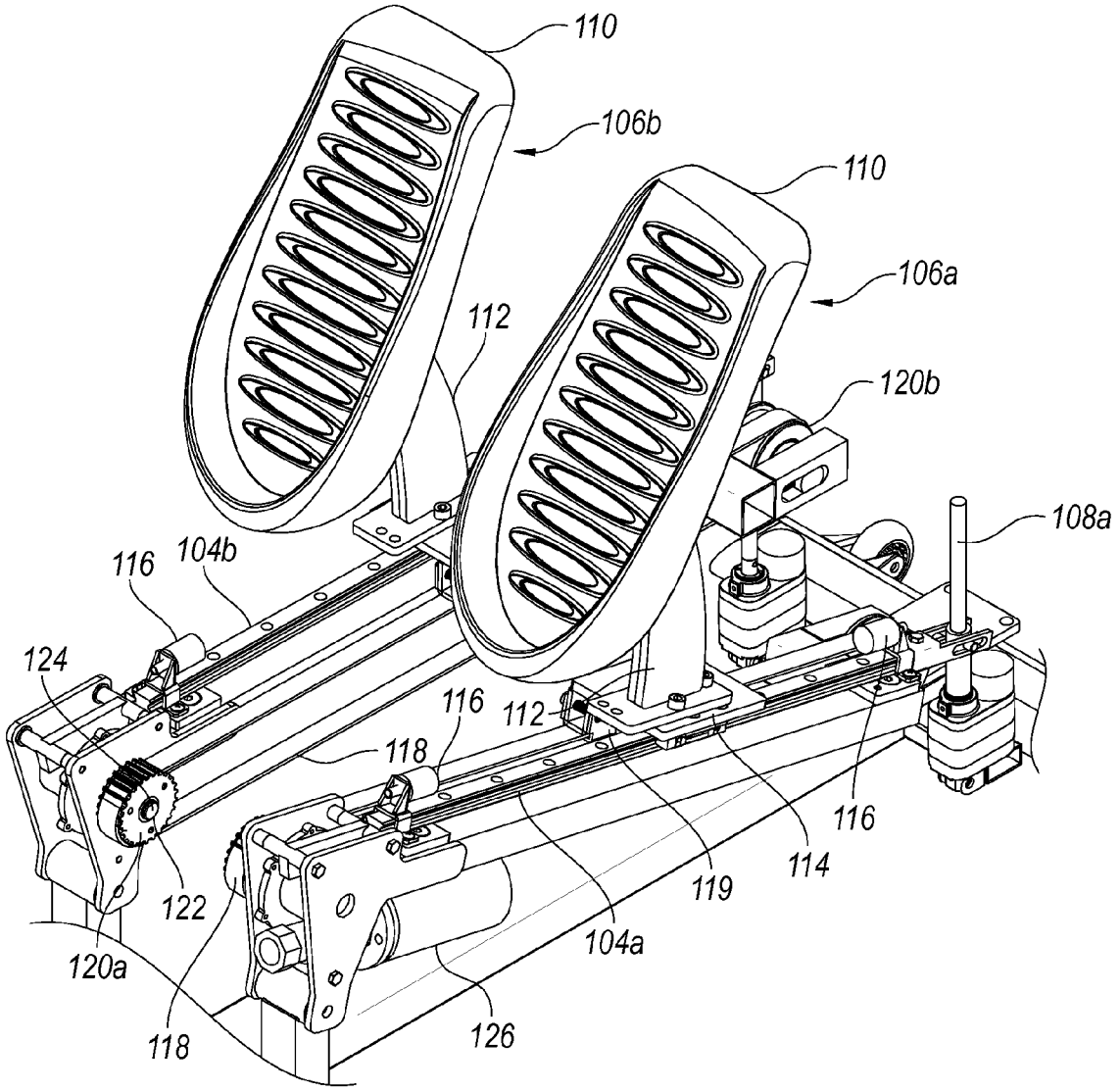
FIG. 1D is an enlarged isometric view of a pedal portion of the recumbent exercise device of FIGS. 1A-1C configured in accordance with an embodiment of the disclosure.

FIG. 1D is an enlarged isometric view of a pedal portion of the exercise apparatus 100 of FIGS. 1A-1C configured in accordance with an embodiment of the disclosure. As shown in FIGS. 1A and 1D, each carriage 114 can be operably coupled to a corresponding belt 118 or other drive member (e.g., a timing belt, a chain, etc.). For example, the carriage 114 can be fixedly attached to the belt 118 by a mounting bracket 119 or other attachment means. The belt 118 can rotate about a first pulley **120*a* and a second pulley 120*b* (collectively referred to as pulleys 120) positioned at opposite end portions of the guide track 104. The first pulley 120*a* (e.g., the pulley 120 closest to the seat 102) can be a drive pulley. The drive pulley 120*a* can be mounted to an output shaft 124 of a motor 126 by a bearing 122. For example, the output shaft 124 can extend outwardly from the motor 126 to connect with the first pulley 120*a*. The motor 126** can be a DC motor, or other type of drive system, such as a worm drive system, a flywheel, etc.

The motor 126 can be configured to limit the rotational speed of the output shaft 124 and in turn limit the speed of pedal movement along the guide track 104. In certain embodiments, for example, each motor 126 can apply a constant resistance to the corresponding pedal assembly 106 (via the shaft 124 and the belt 118) so that the harder the user pushes on the pedal assembly 106, the faster the pedal assembly 106 moves along the guide track 104. When the user pushes the pedal 110 forward along the guide track 104 (i.e., away from the seat 102), the motor 126 acts a generator and applies resistance to the rotation of the shaft 124. For example, the motor 126 can modulate (e.g., increase or decrease) the resistance using pulse width modulation and/or other suitable techniques for modulating the resistance applied to the shaft 124. Once the pedal assembly 106 reaches its furthest point along the guide track 104, the controller 130 can switch the function of the motor 126 such that it serves as a motor to pull the pedal assembly 106 back along the guide track 104 to its home or base position close to the user. As described in further detail below with reference to FIGS. 4A-4E, when the two pedal assemblies 106 are connected to each other (e.g., via a cable) and move reciprocally, the motor 126 does not need to pull the pedal assemblies 106 back to the home position. Instead, the forward motion of one pedal assembly 106 can drive the other pedal assembly 106 in the opposite direction back to the home position.

The motor 126 can be communicatively coupled to the controller 130 that includes software to provides one or more modes of operation and/or resistance. As described in further detail below, the controller 130 can provide speed-based resistance (i.e., isokinetic resistance), speed-dependent resistance (i.e., isotonic resistance), constant passive motion ("CPM") modes, active modes, constant power modes, and/or various other types of software-controlled modes of resistance. In certain embodiments, for example, the motor 126 can communicate with the controller 130 via a feedback loop to apply isokinetic resistance to the pedal assembly 106. For example, the apparatus 100 can detect the force applied to the pedal assembly 106 (e.g., via sensors) to modulate the motor speed to maintain a selected amount of work. In this embodiment, as the user pushes harder on the pedal assembly 106, the controller 130 can communicate with the motor 126 to increase the motor speed such that the user feels less resistance. As described in further detail below, in other embodiments the pedal assemblies 106 can be operably coupled to a belt (e.g., a poly-v belt, or other type of belt) that drives a braking mechanism, such as an eddy-current brake mechanism, that provides resistance to the pedal assemblies 106.

In certain embodiments, the two pedal assemblies 106 can be configured to move reciprocally relative to one another to simulate a natural walking or elliptical motion. For example, when one pedal assembly 106 moves away from the seat 102, the other pedal assembly 106 can be driven back toward the seat 102. The connection between the pedal assemblies 106 can be provided by the controller 130. For example, the motion of one pedal assembly 106 can trigger a corresponding reciprocal motion of the other pedal assembly 106. As described in further detail below, in other embodiments the pedal assemblies 106 can be coupled together for reciprocal movement by a cable (e.g., a rope wire), belt, chain, or other flexible drive member wrapped around one or more pulleys to move the two pedal assemblies 106 back and forth with respect to each other. When each of the two pedal assemblies 106 includes a separate motor 126 for independent pedal movement (e.g., as shown in FIGS. 1A-1D), the exercise apparatus 100 can include a means for returning each pedal assembly 106 to the base or home position (e.g., a position close to the seat 102) after the pedal assembly 106 has been pushed away from the seat 102. For example, in some embodiments the controller 130 can provide this return function.

In the illustrated embodiment, the exercise apparatus 100 includes two driving motors 126, one associated with each pedal assembly 106, and each motor 126 can independently drive its corresponding pedal assembly 106 independent of the other pedal assembly 126. Each motor 126, for example, can be operated at a different speed so that the pedal assemblies 106 are subject to different levels of resistance, rate, etc. This mode of independent operation can be beneficial for rehabilitation purposes when a user has, for example, one leg that is weaker than the other so the user cannot subject both legs to the same level of resistance. In further embodiments, a single driving motor 126 can be operably coupled to both of the pedal assemblies 106 and simultaneously drive and/or apply resistance both pedal assemblies 106. For example, the motor 126 can be operably positioned between the two guide tracks 104 and drive two output shafts 124 that extend from either side of the motor 126 and attach to corresponding two drive pulleys **120*a*. In this embodiment, the pedal assemblies 106 can be operably coupled to each other via a cable and the first pulleys 120*a* can ride on one-way bearings 124 that allow the motor 126 to apply resistance to pedal motion as the pedal assemblies 106 move in a drive direction (e.g., away from the seat 102), and then allows the first pulleys 120*a* to spin freely when rotated in a non-drive direction (e.g., when the pedal assemblies 106 move toward the seat 102) so that the pedal assemblies 106** can return to the home position.

In various embodiments, the pedal assemblies 106 can also be driven upwardly and downwardly in a vertical direction independently of each other by the two corresponding actuators 108. This feature allows the degree of vertical movement of one guide track 104 to differ from that of the other guide track 104, and therefore the exercise apparatus 100 can move the pedal assemblies 106 in different elliptical patterns and/or move one pedal assembly 106 in a linear-step motion while moving the other in an elliptical pattern. The two actuators 108 can also be coordinated so that they move the guide tracks 104 up and down vertically in opposite directions as the pedal assemblies 106 move back and forth to simulate the elliptical motion typically experienced with elliptical exercise machines. For example, the actuators 108 can be communicatively coupled to the controller 130 via a wired or wireless communications link, or mechanically coupled to each other via a plurality of linkages and pivots. In other embodiments, the exercise apparatus 100 can include a single actuator 108 positioned between the two guide tracks 104 and operably coupled to each guide track 104 using linkages that move the two guide tracks 104 upwardly and downwardly in opposite directions. In this embodiment, the reciprocal vertical movement of the guide tracks 104 would be driven by the linkages and the degree of vertical movement of each guide track 104 would be the same.

As further shown in FIGS. 1A-1C, the exercise apparatus 100 can also include levers or arm bars (identified individually as a first arm bar **128*a* and a second arm bar 128*b*, and referred to collectively as arm bars 128) that can provide the user with an upper body workout or rehabilitation. In operation, a user sits in the seat 102, grasps the arm bars 128, places his or her feet on the pedals 110, and moves the arm bars 128 back and forth while moving the pedals 110 back and forth. In the illustrated embodiment, the two arm bars 128 are rotatably coupled to corresponding drive shafts 132 and drive unites (not shown; e.g., motors and/or braking mechanisms) at the base structure 101 of the exercise apparatus 100. The arm bars 128 can be configured to operate independently of the pedal assemblies 106 and the associated motors 126, and therefore the arm bars 128 can be pushed and/or pulled back and forth independent of lower body movement. For example, in some embodiments the arm bars 128 can reciprocate in opposite directions, the arm bars 128 can move together in the same direction, or the arm bars 128 can remain in a stationary position as the pedal assemblies 106 are moved. Similar to the pedal assemblies 106, the arm bars 128 may be configured to operate in independent mode and/or dependent mode. In independent mode, one arm bar 128 can have a different range of motion and/or different resistance level than the other arm bar 128. For example, the controller 130 can limit the range of motion of each arm bar 128 and/or each arm bar 128 can be operably coupled to a separate motor or braking mechanism that can apply a desired level of resistance to the corresponding arm bar 128. In dependent mode, the same range of motion and resistance is applied to both arm bars 128. In various embodiments, the arm bars 128 can be communicatively or operatively coupled to the pedal assemblies 106 such that the motion of the arm bars 128 coordinates with that of the pedal assemblies 106 to simulate a natural walking or stepping motion. For example, the first and second pedal assemblies 106***a* and 106*b* can be communicatively coupled to the corresponding first and second arm bars 128*a* and 128*b* via the controller 130 (e.g., using a wired or wireless connection), which can coordinate their movement such that the each pedal assembly 106 and corresponding arm bar 128 move together as a unit at the same speed. As described in further detail below with reference to FIGS. 4A-4D, in other embodiments, the first and second arm bars 128*a* and 128*b* can be operatively coupled to the first and second pedal assemblies 106*a* and 106*b*, respectively, with linkages. In this configuration, the arm bars 128 and the corresponding pedal assemblies 106 can be driven by the same motors 126. In further embodiments, the exercise apparatus 100 can include different types of arm bars or arm exercise mechanisms, such as a rotary arm exercise apparatus (e.g., an arm bicycle). In further embodiments, the arm bars 128 may be omitted.

The seat 102 can be adjustably positioned along a guide track 134 to accommodate users of various different sizes. In some embodiments, the seat 102 can also be configured to rotate about a vertical axis away from the pedal assemblies 106 to facilitate moving into and out of the seat 102 (e.g., from a wheelchair). For example, a release lever 136 or other release mechanism can be operably coupled to the seat 102 and manipulated (e.g., pulled, pushed, turned, etc.) to release the seat 102 from its forward-facing position. Once released, the seat 102 can be swiveled or otherwise turned to the left or to the right away from pedal assemblies 106 (e.g., as indicated by the arrow in FIG. 1A). In certain embodiments, the seat 102 can be configured to rotate 180° from the forward facing position to facilitate placing a patient or other user onto the seat 102. Once the user is seated, the seat 102 can be rotated forward so that the user faces the guide tracks 104 and exercise with the apparatus 100. In other embodiments, the seat 102 can rotate more than or fewer than 180° (e.g., 360°, 90°, 45°, etc.), or to rotate or include in whole or in part about a horizontal axis. The seat 102 may also be configured to lock at designated positions when the lever 136 is released to provide a more controlled rotation of the seat 102. The seat 102, for example, can be configured to stop at every 45° rotation. The lever 136 may be also be held in its released (e.g., lifted) position to allow the seat 102 to rotate to a desired position.

In various embodiments, a back portion 138 of the seat 102 can be adjustable to accommodate various different seated positions. The back portion 138 can be operably coupled to gas shocks and/or pressurized cylinders (not shown) that can adjust the incline of the back portion 138 with respect to the base of the seat 102 in response to pressure exerted on the back portion 138 by the user.

As further illustrated in FIGS. 1A-1C, the exercise apparatus 100 can include a user interface 140 (e.g., a display screen and/or a touch screen) that can provide information to and receive information from the user. The user interface 140, for example, can provide the user with information related to an exercise or rehabilitation session, such as calories burned, VO2, watts, etc. The user interface 140 can also receive information to define various operational parameters of the exercise or rehabilitation session. For example, the user may be able to select or define a specific range of motion and/or level of resistance via the user interface 140. In other embodiments, the exercise apparatus 100 can be communicatively coupled with a remotely-positioned user interface (e.g., a handheld mobile device, a lap top computer, etc.) that enables, e.g., a clinician to define certain operational parameters of the exercise apparatus 100 and receive data associated with the user's exercise session.

As discussed above, the movement of the pedal assemblies 106 and other features of the exercise apparatus 100 can be controlled by an electronic control system. This electronic control can be provided by the controller 130 and associated software. In the illustrated embodiment, the controller 130 is shown housed in the user interface 140. In other embodiments, however, the controller 130 may be positioned elsewhere on the exercise apparatus 100 and/or the exercise apparatus 100 may be communicatively coupled to a remotely-positioned controller (e.g., via a wireless connection). For example, the controller 130 can be spaced apart from the exercise apparatus 100 to allow a clinician to operate the movement of the exercise apparatus 100 and receive various information therefrom.

The controller 130 can regulate various aspects of the operation of the exercise apparatus 100. For example, the motors 126 can be driven by pulse width modulation ("PWM") controlled by the controller 130 to provide various modes of operation, such as isokinetic operation, CPM operation, etc. The controller 130 can also control the motors 126 by a closed loop servo system to provide CPM operation, isometric operation, controlled range of motion, and/or other modes of operation. In various embodiments, the controller 130 can also change the range of motion of the pedal assemblies 106 along the guide tracks 104. For example, the controller 130 can limit the movement of the pedal assemblies 106 to relatively short strides with respect to the length of the guide tracks 104 by defining start and stop points for the pedal assemblies 106 along the guide tracks 104.

As discussed above, controller 130 can be communicatively coupled to the actuators 108 to control the range of foot motion provided by the pedal assemblies 106. For example, the controller 130 can hold the actuators 108 in a stationary position to provide a linear stepping-type motion, or the controller 130 can control movement of the actuators 108 to allow the pedal assemblies 106 to move in, for example, varying elliptical patterns. The control provided by the controller 130 can also change the pattern of the pedal assembly motion depending on the stride length. For example, the controller 130 can change the pattern of movement from linear motion when short steps are taken (e.g., along only a portion of the guide tracks 104), and the pattern can become increasingly more elliptical when the user's strides become longer.

As shown in FIG. 1A, the controller 130 can also be communicatively coupled to various sensors 142 (shown schematically) that provide information associated with the movement of the exercise device. For example, one or more torque sensors, position sensors, and/or other types of sensors can be operably coupled to the pedal assemblies 106 to provide feedback to the controller 130 for use by the controller 130 in controlling the motors 126 and/or other aspects of the exercise apparatus 100 (e.g., braking mechanisms). Torque sensors can be positioned on the pedals 110, and can be used to measure torque applied to the pedals 110, and the controller 130 can use this information to set limits for resistance. When a torque threshold is passed, then the resistance (e.g., the speed of the motor 126) can be adjusted to provide the desired amount of resistance for the user and/or protect the gear box. In isokinetic resistance modes, for example, the sensors 142 can measure how hard the user pushes on the pedal assembly 106 and, using a control loop algorithm, run the motor 126 faster if the user pushes harder to thereby exert a higher level of resistance on the corresponding pedal assembly 106 so that the speed of the pedal assembly 106 does not change. Positional sensors can be positioned on the pedal assemblies 106 and/or the guide tracks 104, and the controller 130 can receive signals from the positional sensors to determine the location of the pedal assemblies 106 with respect to the guide tracks 104. The controller 130 can use this information to limit the range of motion of the pedal assemblies 106 along the guide tracks 104.

The information from the sensors 142 can also be used to gather various data related to the user's movement. For example, positional data gathered from position sensors that monitor the linear movement of the pedal assemblies 106 along the guide tracks 104 can be used to understand the user's range of leg motion. Toque data collected from torque sensors can provide information related to the user's musculoskeletal deficiencies in strength. The data collected from the sensors 142 can also be used to provide bilateral work measurements, that is, the differences in the range of motion and/or force of the user's left leg versus the user's right leg. In addition, the sensor data can be used to facilitate accurate measurements of calories, watts, metabolic equivalents ("METs"), VO2, and/or other exercise and rehabilitation related parameters. This information can be displayed on the user interface 140 and/or on a remote device, such as a computer monitored by a clinician.

During operation of the exercise apparatus 100 of FIGS. 1A-1D, the user can move the foot pedal assemblies 106 in generally elliptical patterns, and can independently select or otherwise specify different operational parameters (e.g., resistance settings) for his or her left and right legs. For example, the motors 126 can apply different levels of resistance to each pedal assembly 106. The two actuators 108 can move the guide tracks 104 up and down to different degrees or positions, and therefore the left and right pedal assemblies 106*a* and 106*b* can provide the different patterns when the user applies force to the pedals 110. In addition, because the pedal assemblies 106 are not mechanically coupled to each other, the controller 130 can communicate with the foot pedal assemblies 106 to independently define the ranges of movement for the user's left leg and right legs. The sensors 142 can also provide feedback to the controller 130 to determine if the operating conditions of the exercise device 100 should be modified. For example, the sensors 142 can detect if the torque applied to the pedal assemblies 106 is more than or less than a desired level, and the controller 130 can communicate with the motors 126 to adjust the resistance on each pedal assembly 106 accordingly. The independent control of various aspects of each side of the exercise apparatus 100 allows for highly customized workout and rehabilitation regimes.

Figure 2:
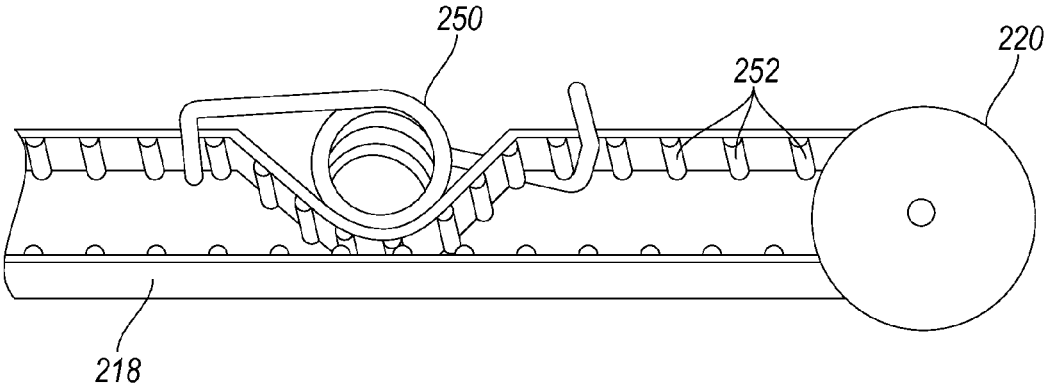
FIG. 2 is an enlarged isometric view of a belt tensioning mechanism configured in accordance with an embodiment of the disclosure.

FIG. 2 is an enlarged isometric view of a belt tensioning mechanism 250 configured in accordance with an embodiment of the disclosure. As shown in FIG. 2, the belt tensioning mechanism 250 can include a spring, and can be attached directly to a belt 218 carried by a pulley 220. The belt 218 can be, for example, the belts 118 described above that are used to drive the pedal assemblies 106, and/or the belts described below with reference to FIGS. 4A-4D. In various embodiments, the belt 218 can include a plurality of teeth or ridges 252 (e.g., v-shaped ridges) on its inner surface. The belt tensioning mechanism 250 can take up slack in the belt 218 when the opposite side of the belt 218 is tensioned. The belt tensioning mechanism 250 can be used in place of costlier idler wheels, ball bearings, axels, and/or adjustable mounting plates that are typically used for tensioning belts, and therefore the belt tensioning mechanism 250 can reduce the cost associated with tensioning belts.

Figure 3:
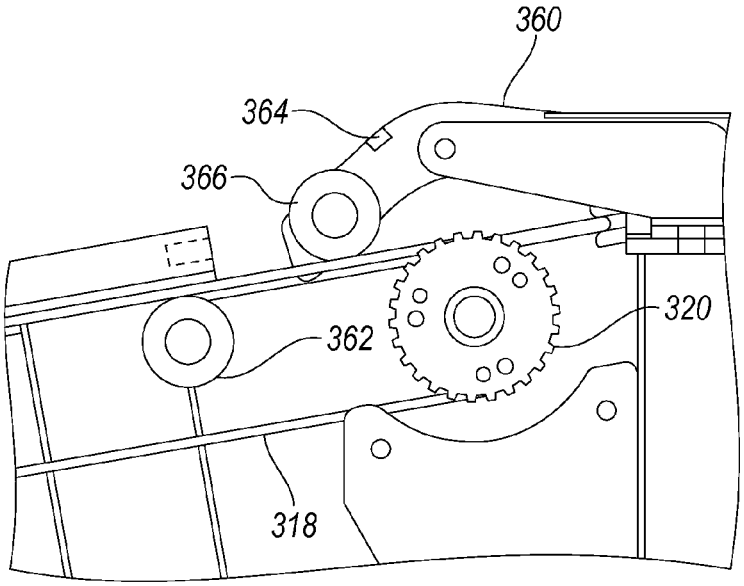
FIG. 3 is an enlarged side view of a spring-loaded tension arm acting on a belt in accordance with an embodiment of the disclosure.

FIG. 3 is an enlarged view of a spring-loaded tension arm 360 ("tension arm 360") acting on a belt 318 in accordance with an embodiment of the disclosure. The tension arm 360 can be incorporated into various embodiments of the recumbent exercise machines (e.g., the exercise apparatus 100 of FIGS. 1A-1D) disclosed herein to determine the force a user applies to a pedal assembly. In operation, the tension arm 360 applies a downward force with a roller 366 or other member via a biasing member, such as a spring (not shown), to a fixed length of the belt 318 at a generally central portion thereof. The fixed length of the belt 318 can be defined by the length of the belt 318 extending between a first or timing pulley 320 and a secondary pulley 362, and the tension arm 360 can apply a downward force at a central region of the belt 318 between the two pulleys 320 and 362. When a user applies force against or pushes a pedal assembly (e.g., the pedal assembly 106 described above) that rides on the belt 318 (e.g., as described above with reference to FIGS. 1A-1D), the belt 318 is pulled taught by the counterforce of the timing pulley 320. This tightening of the belt 318 deflects the tension arm 360 away from the belt 318. The degree of deflection can be detected by a measurement device 364 (shown schematically), such as a potentiometer, an encoder, a Hall effect sensor, and/or other measurement device that can detect the deflection of the tension arm 360, and this measurement can be used to determine the amount of force applied to each pedal assembly. The force data can be used by a controller (e.g., the controller 130 described above) and/or other device to adjust the resistance applied to the pedal assembly, determine or estimate the user's musculoskeletal condition, and/or provide other feedback related to the force applied to the pedal assembly.

Figure 4A:
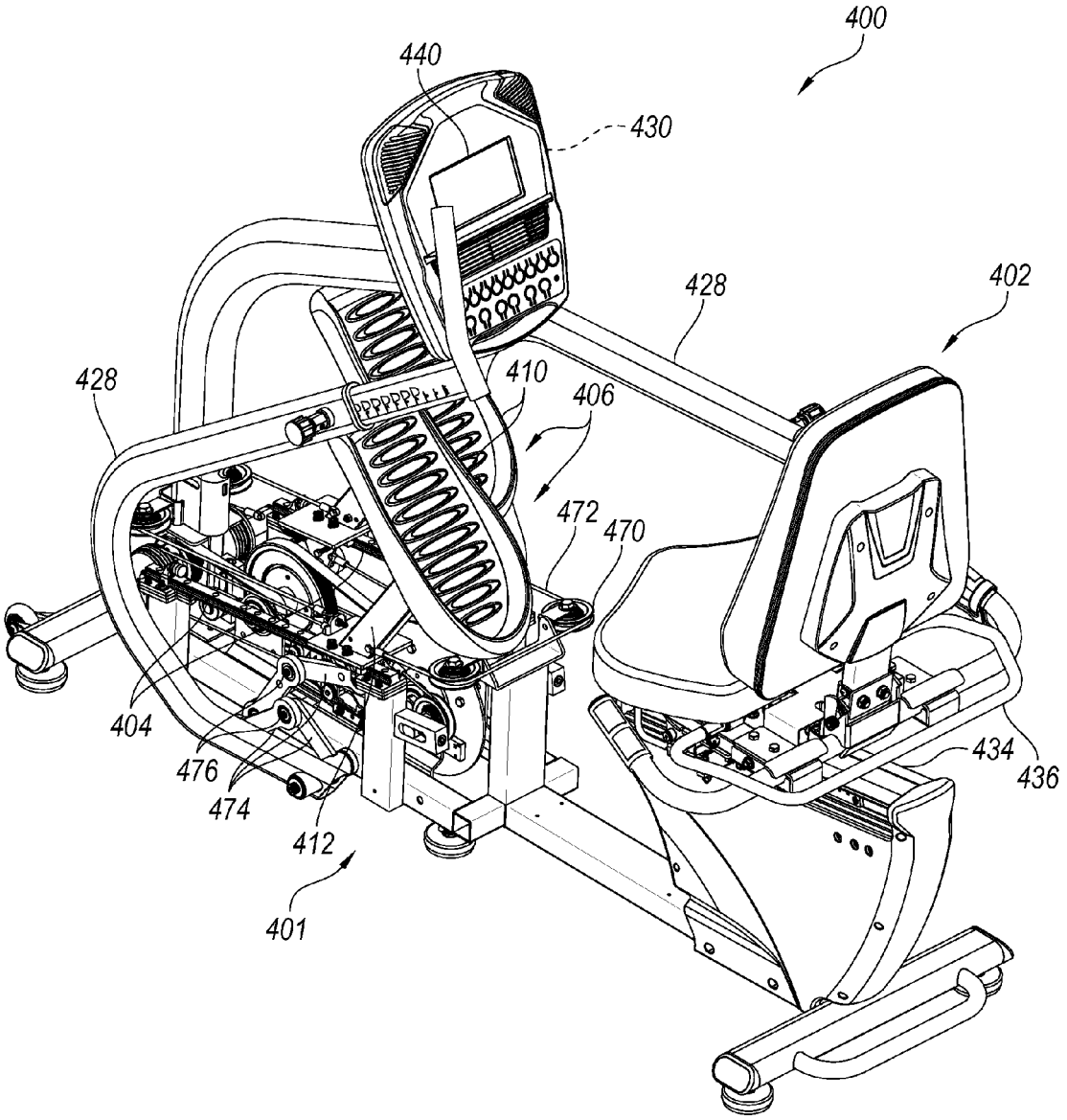
FIGS. 4A and 4B are isometric and side views, respectively, of a recumbent exercise device configured in accordance with another embodiment of the disclosure.
Figure 4B:
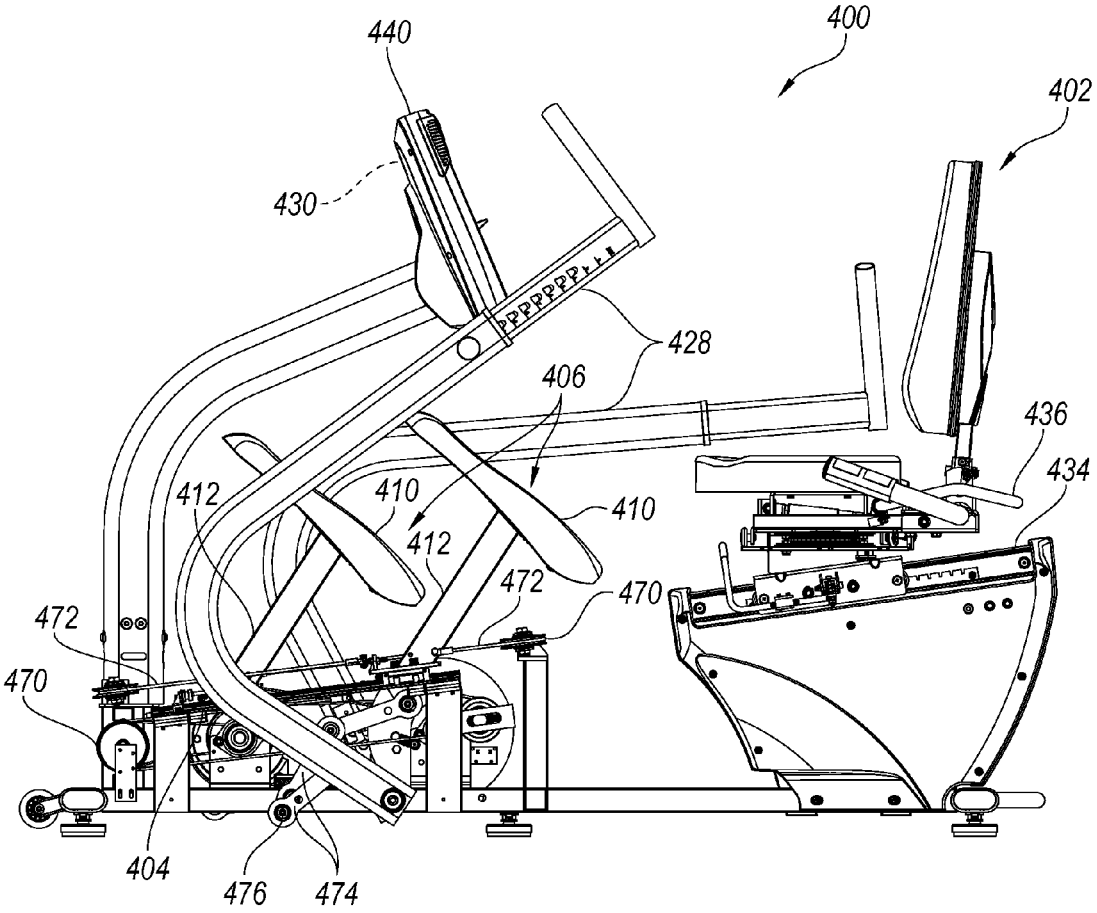
Figure 4C:
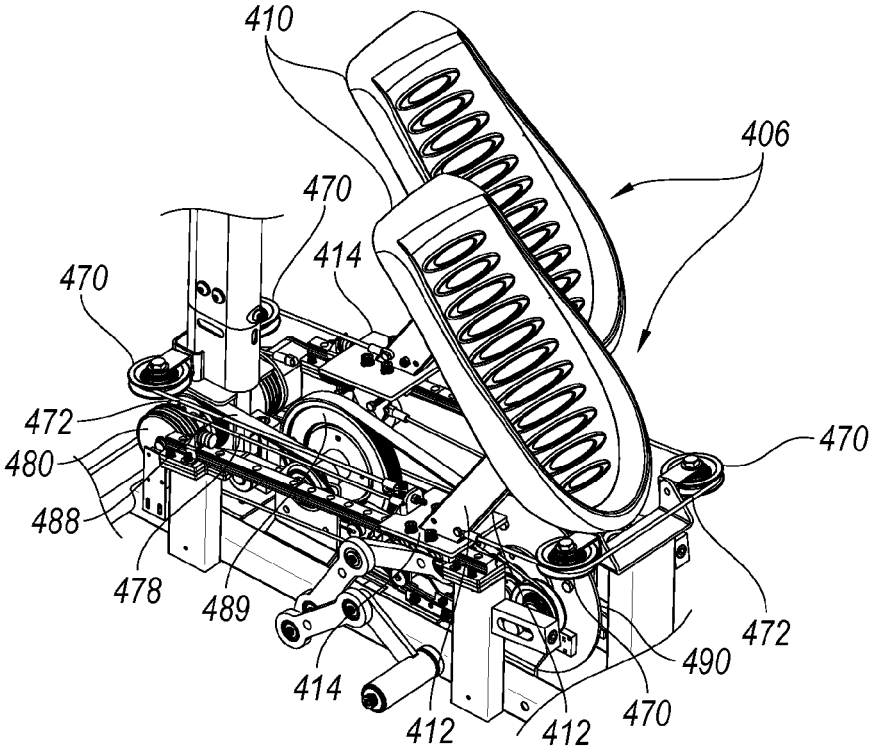
FIG. 4C is an enlarged isometric view of a pedal portion of the recumbent exercise device of FIGS. 4A and 4B configured in accordance with an embodiment of the disclosure.
Figure 4D:
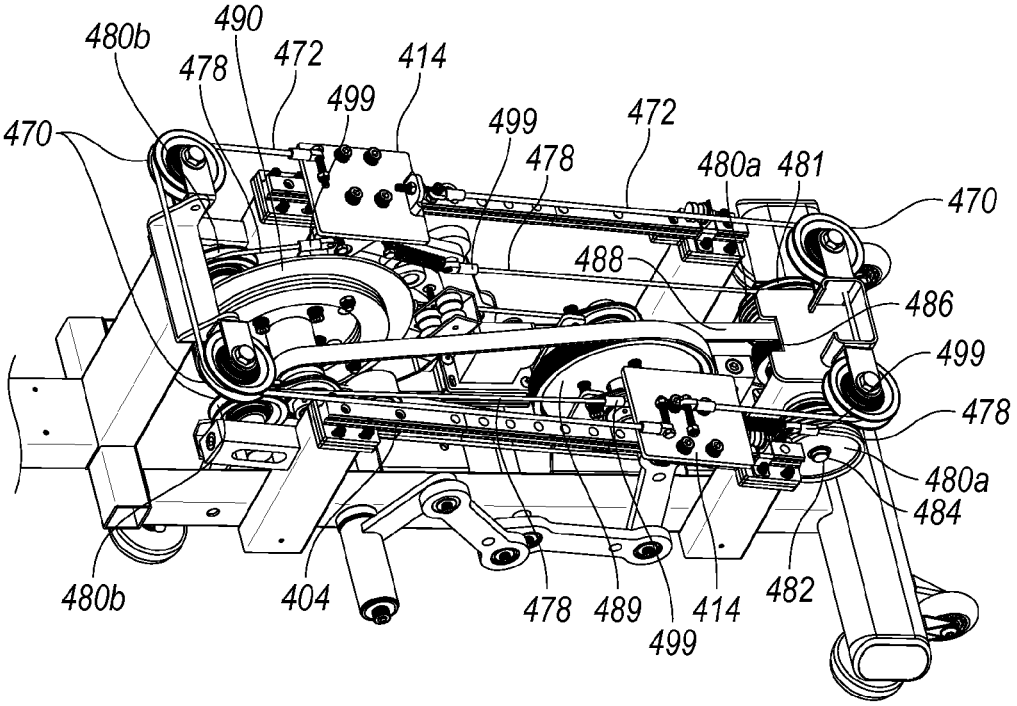
FIGS. 4D and 4E are other isometric views of the pedal portion and a braking portion with the pedals removed for clarity.
Figure 4E:
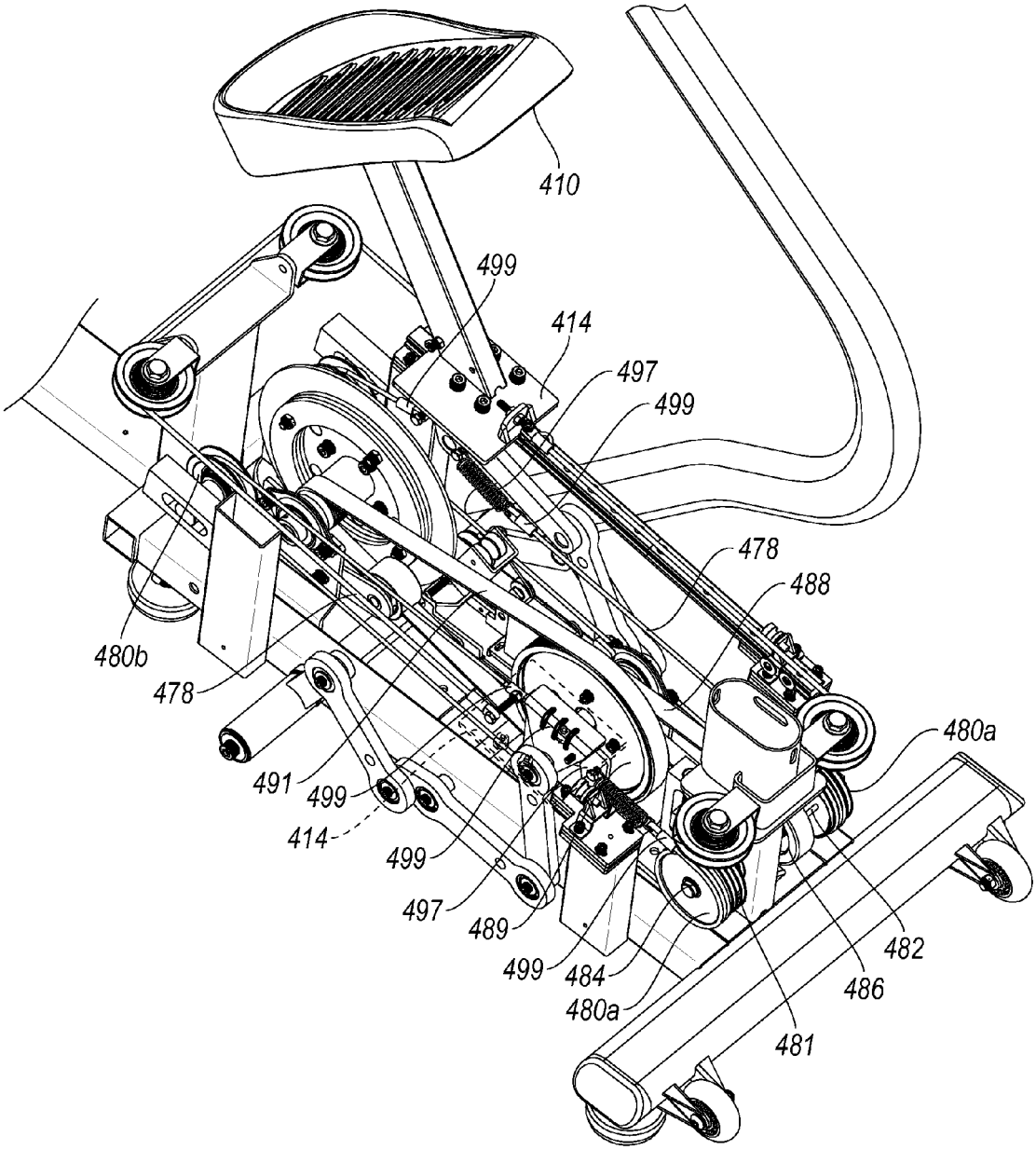

FIGS. 4A and 4B are isometric and side views, respectively, of a recumbent exercise apparatus 400 ("exercise apparatus 400") configured in accordance with another embodiment of the disclosure. FIG. 4C is an enlarged isometric view of a pedal portion of the exercise apparatus 400, and FIGS. 4D and 4E are an enlarged isometric views of the pedal and braking portions with pedals removed for clarity. The exercise apparatus 400 can include several features generally similar in structure and/or function to those of the exercise apparatus 100 described above with reference to FIGS. 1A-1D. For example, the exercise apparatus 400 includes a seat 402 and a pair of guide tracks 404 (e.g., linear guide tracks) mounted to a base structure 401. Each of the guide tracks 404 carries a corresponding foot pedal assembly 406. The seat 402 can include a lever 436 that allows the user to adjust the position of the seat 402 along the length of a rail 434 and/or rotate the seat 402 about a vertical axis away from the pedal assemblies 406 to facilitate positioning the user onto the seat 402. The exercise apparatus 400 can also include a user interface 440 for receiving information from and providing information to the user and a controller 430 that uses software to control the motion of the pedal assemblies 406, detect various measurements from sensors (not shown) on the pedal assemblies 406 or guide tracks 404, and/or otherwise control the operation of the exercise apparatus 400.

Similar to the pedal assemblies 106 described above, the pedal assemblies 406 shown in FIGS. 4A-4C can include pedals 410 connected to lever arms 412, which are in turn connected to pedal bases 414 (FIG. 4C) that slide back and forth along the corresponding guide tracks 404 to provide a linear stepping motion. As shown in FIGS. 4C and 4D, the pedal assemblies 406 can be operably coupled to each other with a plurality of pulleys 470 and cables 472 (e.g., wires, ropes, etc.) attached to the pedal bases 414 and/or other portions of the pedal assemblies 406. In this embodiment, the pedal assemblies 406 operate in dependent mode such that movement of one pedal assembly 406 causes the reciprocal movement of the other pedal assembly 406. For example, when one pedal assembly 406 is pushed forward along one guide track 404, the other pedal assembly 406 is moved backward along the other guide track 404 to the same degree. In other embodiments, the movement of the pedal assemblies 406 is independent of each other.

As shown in FIGS. 4D and 4E, each pedal base 414 and/or another portion of each pedal assembly 406 can be attached to both ends 499 of a cable 478 (e.g., a wire rope) that wraps around a first pulley or spool 480*a* positioned proximate to one end of a corresponding guide track 404, and a second pulley or spool 480*b* positioned proximate to the opposite end of the guide track 404. As shown in FIG. 4E, the ends 499 of each cable 478 can have a fitting (e.g., with an eyelet) that couples to the underside of the pedal base 414 using a bolt or other attachment mechanism. In the illustrated embodiment, the fitting on one end 499 of each cable 478 is attached to a spring 497 that is in turn bolted or otherwise attached to the corresponding pedal base 414. The springs 497 can take up the slack in the cables 478 as the pedal assemblies 406 (FIGS. 4A-4C) move back and forth along the guide tracks 404.

As further shown in FIG. 4E, the cable 478 can be wrapped around a helical groove 481 in the first pulley 480*a* several times (e.g., two times, three times, five times, etc.). In the illustrated embodiment, the first pulley 480*a* is positioned apart from the seat 102 (FIGS. 4A and 4B) and away from the user, but in other embodiments the first pulley 480*a* can be positioned elsewhere along the base structure 401 of the exercise apparatus 400 (e.g., proximate to the user). The pair of first pulleys 480*a* corresponding to the two pedal assemblies 406 can be rotatably mounted to a shaft 482 with one way bearings 484. The shaft 482 may be coupled to another pulley 486 that carries a first driving member 488 (e.g., a timing belt), and in turn couples to a drive unit or braking mechanism 493. As shown in FIG. 4E, the driving member 488 can be operably wound around a hub 495 that drives a pulley 489. The pulley 489 is in turn rotatably coupled to a spinning disc 490 (e.g., an aluminum disc via a belt 491). In the illustrated embodiment, the braking mechanism 493 is an eddy current brake that applies permanent magnets (e.g., four permanent magnets) to the spinning disc 490 to create resistance by moving the permanent magnets towards and away from the disc 490. Similar features related to creating resistance with a helical drive pulleys are described in further detail in U.S. Pat. No. 4,949,993, which is incorporated herein in its entirety. In other embodiments, however, various other types of braking mechanisms (e.g., worm drives, DC motors, flywheels, etc.) associated with driving members can be used to impart resistance to the movement of the pedal assemblies 406.

As shown in FIG. 4A, the exercise apparatus 400 can further include a pair of arm levers 428 that the user can grasp with each hand and move back and forth to provide the user with an upper body workout. In the illustrated embodiment, the arm levers 428 are operably coupled to the foot pedal assemblies 406 via a plurality of linkages 474 and pivots 476, and therefore movement of the arm levers 428 is coordinated with (e.g., dependent on) movement of the pedal assemblies 406. Accordingly, in various embodiments, the same braking mechanism used to apply resistance to the movement of the pedal assemblies 406 can be applied to the arm levers 428. In other embodiments, the arm levers 428 can operate independently of the pedal assemblies 406.

From the foregoing, it will be appreciated that specific embodiments of the disclosure have been described herein for purposes of illustration, but that various modifications may be made without deviating from the spirit and scope of the invention. Aspects of the invention described in the context of particular embodiments may be combined or eliminated in other embodiments. Further, while advantages associated with certain embodiments of the invention have been described in the context of those embodiments, other embodiments may also exhibit such advantages, and no embodiment need necessarily exhibit such advantages to fall within the scope of the invention. Accordingly, the invention is not limited, except as by the appended claims.

We claim:

1. A recumbent exercise apparatus, comprising:

a seat;

a guide track forward of the seat;

a foot pedal assembly movably coupled to the guide track and is completely forward of the seat, wherein the pedal assembly is configured to move along a first predetermined length of the guide track; and an actuator operably coupled to the guide track and configured to move the guide track in a vertical direction, wherein the pedal assembly is configured to move in a first elliptical pattern when the pedal assembly moves back and forth along the guide track and the actuator moves the guide track in a vertical direction.

2. The recumbent exercise apparatus of claim 1 wherein the guide track is a first guide track, the pedal assembly is a first pedal assembly, and the actuator is a first actuator, and wherein the recumbent exercise apparatus further comprises:

a second guide track forward of the seat;

a second pedal assembly movably coupled to the second guide track, wherein the second pedal assembly is configured to move along a second predetermined length of the second guide track; and a second actuator operably coupled to the second guide track and configured to move the second guide track in a vertical direction.

3. The recumbent exercise apparatus of claim 2 wherein the first and second pedal assemblies are configured to move independently of each other along the corresponding first and second guide tracks.

4. The recumbent exercise apparatus of claim 3, further comprising means for returning the first and second pedal assemblies to a predetermined base position positions.

5. The recumbent exercise apparatus of claim 3, further comprising a controller communicatively coupled to the first and second pedal assemblies, wherein the controller is configured to apply different resistance levels to the first and second pedal assemblies.

6. The recumbent exercise apparatus of claim 2, further comprising a controller communicatively coupled to the first and second pedal assemblies, wherein the controller is configured to set a first start position and a first stop position on the first guide track for the first pedal assembly, and a second start position and a second stop position on the second guide track for the second pedal assembly, wherein the first start position and the first stop position defines the first predetermined length, and the second start position and the second stop position defines the second predetermined length.

7. The recumbent exercise apparatus of claim 6 wherein the first start position and the second start position are set at different positions on, respectively, the first guide track and the second guide track.

8. The recumbent exercise apparatus of claim 6, wherein the controller is configured to set the first start position and the first stop position by causing the first pedal assembly to provide a high level of resistance at the first start position and at the first stop position than when the first pedal assembly is at a position between the first start position and the first stop position.

9. The recumbent exercise apparatus of claim 2, further comprising:

a first motor operably coupled to the first pedal assembly; and a second motor operably coupled to the second pedal assembly, wherein the first and second motors are configured to provide resistance to the first and second pedal assemblies independently of each other.

10. The recumbent exercise apparatus of claim 2, further comprising a motor operably coupled to the first and second pedal assemblies, wherein the motor is configured to resist movement of the first and second pedal assemblies as the first and second pedal assemblies move along the corresponding first and second guide tracks.

11. The recumbent exercise apparatus of claim 2 wherein the first and second pedal assemblies are operably coupled to each other, and wherein movement of the first pedal assembly along the first guide track is dependent upon movement of the second pedal assembly along the second guide track.

12. The recumbent exercise apparatus of claim 2, wherein the first actuator and the second actuator are configured to cause the first guide track and the second guide track to perform different vertical movements.

13. The recumbent exercise apparatus of claim 12, wherein the different vertical movements are performed by the first guide track and the second guide track at the same time.

14. The recumbent exercise apparatus of claim 12, wherein the first actuator is configured to cause the first guide track to move at a first direction, and the second actuator is configured to keep the second guide track at a predetermined position.

15. The recumbent exercise apparatus of claim 12, wherein the first actuator is configured to cause the first guide track to move along a first predetermined vertical distance, and the second actuator is configured to cause the second guide track to move along a second predetermined vertical distance.

16. The recumbent exercise apparatus of claim 15, wherein the first predetermined vertical distance is configured to cause the first pedal assembly to move in the first elliptical pattern, and the second predetermined vertical distance is configured to cause the second pedal assembly to move in a linear-step motion.

17. The recumbent exercise apparatus of claim 15, wherein the first predetermined vertical distance is configured to cause the first pedal assembly to move in the first elliptical pattern, and the second predetermined vertical distance is configured to cause the second pedal assembly to move in a second elliptical pattern different from the first elliptical pattern.

18. The recumbent exercise apparatus of claim 15, wherein the first predetermined length is configured to cause the first pedal assembly to move in the first elliptical pattern, and the second predetermined length is configured to cause the second pedal assembly to move in a linear motion.

19. The recumbent exercise apparatus of claim 15, wherein the first predetermined length is configured to cause the first pedal assembly to move in the first elliptical pattern, and the second predetermined length is configured to cause the second pedal assembly to move in a second elliptical pattern.

20. The recumbent exercise apparatus of claim 2, wherein the first pedal assembly is configured to move at a first speed, and the second pedal assembly is configured to move at a second speed.

21. The recumbent exercise apparatus of claim 20, wherein the first pedal assembly is configured to provide a first resistance level based on the first speed, and the second pedal assembly is configured to provide a second resistance level based on the second speed.

22. The recumbent exercise apparatus of claim 21, wherein the first resistance level sets a first range of movement of the first pedal assembly by a user operating the recumbent exercise apparatus, wherein the second resistance level sets a second range of movement of the second pedal assembly by the user.

23. The recumbent exercise apparatus of claim 2, wherein the first pedal assembly is configured to move at a first direction when the second pedal assembly moves at a second direction.

24. The recumbent exercise apparatus of claim 23, wherein the first pedal assembly is configured to provide a first resistance level based on the first direction, and the second pedal assembly is configured to provide a second resistance level based on the second direction.

25. The recumbent exercise apparatus of claim 24, wherein the first resistance level sets a first range of movement of the first pedal assembly by a user operating the recumbent exercise apparatus, wherein the second resistance level sets a second range of movement of the second pedal assembly by the user.

26. The recumbent exercise apparatus of claim 1, wherein the guide track is a first guide track, the pedal assembly is a first pedal assembly, and the actuator is a first actuator, and wherein the recumbent exercise apparatus further comprises:

a second guide track forward of the seat;

a second pedal assembly movably coupled to the second guide track, wherein the second pedal assembly is configured to move along a second predetermined length of the second guide track, and wherein the actuator is operably coupled to the first and second guide tracks and configured to move the first and second guide tracks vertically in opposite directions to provide an elliptical pattern as the first and second pedal assemblies move along the lengths of the first and second guide tracks, respectively.

27. The recumbent exercise apparatus of claim 1, further comprising a motor operably coupled to the pedal assembly, wherein operation of the motor is configured to change resistance to movement of the pedal assembly along the first predetermined length of the guide track.

28. The recumbent exercise apparatus of claim 27, further comprising:

a drive pulley operably coupled to the motor; and a drive member operably coupling the drive pulley to the pedal assembly, wherein the drive pulley is configured to limit motion of the pedal assembly in a first direction, and wherein the drive pulley is configured to allow the pedal assembly to move freely in a second direction opposite the first direction.

29. The recumbent exercise apparatus of claim 1, further comprising an arm bar for grasping by a user, wherein the arm bar is configured to move independently of the pedal assembly.

30. The recumbent exercise apparatus of claim 1, further comprising:

a motor configured to change resistance to movement of the pedal assembly along the length of the guide track;

a drive pulley operably coupled to the motor;

a belt carried by the drive pulley and operably coupled to the pedal assembly; and a belt tensioning mechanism attached to the belt, wherein the belt tensioning mechanism is configured to take up slack in a portion of the belt when another portion of the belt is tensioned.

31. The recumbent exercise apparatus of claim 1, further comprising:

a motor;

a drive pulley operably coupled to the motor;

a belt carried by the drive pulley and operably coupled to the pedal assembly, wherein the motor is configured to change resistance to movement of the pedal assembly along the length of the guide track by means of the drive pulley and the belt; and a tension arm configured to apply force to the belt, wherein deflection of the tension arm by the belt is configured to correlate to a force applied to the pedal assembly.

32. The recumbent exercise apparatus of claim 1, further comprising a controller configured to drive the pedal assembly in a constant passive movement (CPM) mode, isokinetic mode, and/or controlled range of motion mode.

33. The recumbent exercise apparatus of claim 1, further comprising a controller operably coupled to the actuator, wherein the controller is configured to change a range of motion of the actuator to allow the pedal assembly to move in a linear motion, an elliptical motion, and/or a rotary motion.

34. The recumbent exercise apparatus of claim 1 wherein the guide track is a linear guide track, and wherein the actuator is a linear actuator.

35. The recumbent exercise apparatus of claim 1, wherein the first predetermined distance and the second predetermined distance are defined by one or more stoppers on each of the first guide track and the second guide track.

36. A recumbent exercise machine, comprising:

a seat;

a movable linear guide track forward of the seat;

a foot pedal assembly slideably coupled to the linear guide track, wherein the foot pedal assembly is configured to move in an elliptical path as the pedal assembly slides back and forth along the linear guide track; and a drive unit operably coupled to the pedal assembly, wherein the drive unit is configured to apply resistance to the pedal assembly in a first direction, and wherein the drive unit is configured to allow the pedal assembly to move freely in a second direction opposite the first direction, wherein the drive unit includes:

a motor having an output shaft, a pulley mounted to the output shaft; and a drive member operably coupling the pulley to the pedal assembly;

and wherein the pulley is a first pulley, and wherein the recumbent exercise machine further comprises:

a second pulley having a helical groove, wherein the second pulley is coupled to the first pulley; and a cable connected to the pedal assembly and carried by the second pulley.

37. The recumbent exercise device of claim 36 further comprising a motor operably coupled to the foot pedal assembly, wherein operation of the motor is configured to change resistance to movement of the pedal assembly along the length of the linear guide track.

38. The recumbent exercise apparatus of claim 37, further comprising a controller communicatively coupled to the motor, wherein the controller is configured to receive user input and move the pedal assembly in a constant passive motion (CPM).

39. The recumbent exercise apparatus of claim 37, further comprising a controller communicatively coupled to the motor, wherein the controller is configured to receive user input and adjust resistance provided by the motor to the pedal assembly.

40. The recumbent exercise apparatus of claim 37 wherein the motor is configured to apply speed-based resistance to the pedal assembly.

41. A recumbent exercise machine, comprising:

a seat;

a movable linear guide track forward of the seat;

a foot pedal assembly slideably coupled to the linear guide track, wherein the foot pedal assembly is configured to move in an elliptical path as the pedal assembly slides back and forth along the linear guide track;

a drive unit operably coupled to the pedal assembly, wherein the drive unit is configured to apply resistance to the pedal assembly in a first direction, and wherein the drive unit is configured to allow the pedal assembly to move freely in a second direction opposite the first direction; and a linear actuator operably coupled to the linear guide track and configured to move the linear guide track along a vertical arc, wherein the pedal assembly is configured to move in a substantially elliptical pattern when the pedal assembly moves back and forth along the linear guide track and the linear actuator moves the linear guide track along the vertical arc.

42. A recumbent exercise machine, comprising:

a seat;

a guide track forward of the seat movable along a vertical arc;

a foot pedal assembly slideably coupled to the guide track and is completely forward of the seat; and means for moving the pedal assembly in an elliptical pattern when the pedal assembly moves back and forth along the length of the guide track and when the guide track moves along the vertical arc.

* * * * *